US007513464B1

(12) United States Patent
Berfield

(10) Patent No.: US 7,513,464 B1
(45) **Date of Patent: *Apr. 7, 2009**

(54) HOSE HOLDER

(75) Inventor: Robert C. Berfield, Jersey Shore, PA (US)

(73) Assignee: Shop-Vac Corporation, Williamsport, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/686,467

(22) Filed: Mar. 15, 2007

Related U.S. Application Data

(63) Continuation-in-part of application No. 10/807,006, filed on Mar. 23, 2004, now Pat. No. 7,191,989.

(51) Int. Cl.
*A47G 29/00* (2006.01)

(52) U.S. Cl. ..... 248/90; 248/89; 15/323

(58) Field of Classification Search ..... 248/89, 248/90, 75, 79, 309.1; 15/323, 314, 351; 451/494; 24/339, 545
See application file for complete search history.

(56) References Cited

U.S. PATENT DOCUMENTS

| | | | | |
|---|---|---|---|---|
| 2,049,603 | A | 8/1936 | Dietenberger | 15/14 |
| 2,313,423 | A | 3/1943 | Dodd | 15/257 |
| 2,549,349 | A | 4/1951 | Wahlstrom | 211/13 |
| 2,634,451 | A | 4/1953 | Dow | 15/327 |
| 2,819,485 | A | 1/1958 | Sparklin | 15/323 |
| 2,955,790 | A | 10/1960 | Sylvester | 248/65 |
| 3,213,480 | A | 10/1965 | Miller | 15/314 |
| 3,747,166 | A | 7/1973 | Eross | 24/81 |
| 3,872,538 | A | 3/1975 | Crouser | 15/323 |
| 3,897,923 | A | 8/1975 | Paepke et al. | 248/75 |
| 3,955,236 | A | 5/1976 | Mekelburg | 15/314 |
| 3,955,237 | A | 5/1976 | Chateauneuf et al. | 15/323 |
| 4,406,434 | A | 9/1983 | Schneckloth | 248/83 |
| 4,541,142 | A | 9/1985 | Pudwill | 15/323 |
| 4,606,735 | A | 8/1986 | Wilder et al. | 604/180 |
| 5,029,792 | A | 7/1991 | Desjardins | 248/309 |
| 5,054,723 | A * | 10/1991 | Arnold | 248/65 |
| 5,115,542 | A | 5/1992 | Gehres | 24/543 |
| 5,120,012 | A | 6/1992 | Rosenau | 248/201 |
| 5,137,156 | A | 8/1992 | Riczinger et al. | 211/13 |
| 5,311,909 | A | 5/1994 | Adcock | 137/899 |
| 6,311,936 | B1 | 11/2001 | Herr et al. | 248/75 |
| 6,446,915 | B1 | 9/2002 | Ismert | 248/68.1 |
| 6,478,342 | B1 | 11/2002 | Berfield | 205/276 |
| 6,502,276 | B2 | 1/2003 | Iversen | 15/323 |
| 6,588,052 | B2 | 7/2003 | Iversen | 15/323 |
| 6,619,596 | B1 | 9/2003 | Caine et al. | 248/49 |
| 6,700,064 | B2 | 3/2004 | Aoki et al. | 174/69 |
| 6,708,934 | B2 | 3/2004 | Brueske | 248/80 |
| 6,883,202 | B2 | 4/2005 | Steffen et al. | 15/323 |
| 7,159,272 | B2 | 1/2007 | Holsten et al. | 15/323 |
| 7,175,031 | B2 | 2/2007 | Matthews | 211/70.6 |
| 7,191,989 | B2 * | 3/2007 | Berfield | 248/90 |
| 2005/0198764 | A1 | 9/2005 | Heatley | 15/323 |
| 2005/0211854 | A1 | 9/2005 | Berfield | 248/80 |
| 2006/0214070 | A1 | 9/2006 | Yu Chen | 248/80 |

* cited by examiner

*Primary Examiner*—A. Joseph Wujciak, III
(74) *Attorney, Agent, or Firm*—Marshall, Gerstein & Borun LLP

(57) ABSTRACT

A holder for storing ribbed vacuum cleaner hoses and associated vacuum cleaner tubes that includes a pair of support members mounted on a support, each support member having one or more ribs to engage the corrugated surface of the hose.

1 Claim, 12 Drawing Sheets

HOSE HOLDER

This application is a continuation-in-part of my application for "Hose Holder", application Ser. No. 10/807,006, filed Mar. 23, 2004 now U.S. Pat. No. 7,191,989.

FIELD OF THE INVENTION

The invention relates to a holder for corrugated vacuum cleaner hoses and the like.

DESCRIPTION OF THE PRIOR ART

Vacuum cleaners are common household, shop, and outdoor tools. Many vacuum cleaners have a body containing an air pump and a depository for debris. The body is connected to a hose used to draw air and debris into the machine. Specialized cleaning tools are attached to the free end of the hose to facilitate cleaning tasks.

Vacuum cleaner hoses come in a variety of sizes and diameters. Smaller diameter hoses are preferred for collecting liquid debris and interior house cleaning, while larger diameter hoses are useful for collecting larger debris found in a workshop or outdoors. One vacuum cleaner can use a number of different size hoses.

The hoses are long, stiff and intentionally non-collapsible. Commonly, vacuum hoses have circumferential or spiral wound corrugations that extend along the length of the hose. This structure increases hose strength and permits flexing of the hose but makes hose storage difficult.

Storage racks that can accommodate vacuum cleaner hoses are known. The racks may be wall mounted or mounted on the vacuum cleaner body. Some of these racks are constructed from molded plastic or metal frames. The racks are large, expensive and complicated to produce and assemble. They cannot be stored compactly, a feature desirable for reducing packaging and transport cost. Often, conventional racks are not designed to accept hoses of different diameters.

Installation of racks mountable on vacuum cleaner bodies is problematic. Racks must be made to custom fit specific vacuum cleaner designs. Racks must be mounted with care to vacuum cleaner bodies to avoid damaging the air pump or breaching the debris depository.

There is additional difficulty when vacuum cleaner hoses are stored in rooms with unfinished walls having exposed studs, such as closets, basements or garages. These rooms lack a continuous flat mounting surface. Conventional wall-mounted hose storage racks are difficult to mount on walls with exposed studs and do not make efficient use of available space between studs.

Tapered vacuum tubes are conventionally mounted on the end of a corrugated vacuum cleaner hose in order to permit a user to grip the end of the hose away from the cleaner and direct the open end of the tubes mounted on the hose for vacuum pick up of debris. The vacuum tubes are long, tapered bodies which should be stored adjacent the hose so that both the hose and the tubes are available in one location when needed for vacuum pick up of debris.

Therefore, there is need for a mountable holder for corrugated vacuum cleaner hoses that is inexpensive to produce and easy for a user to assemble and mount on a variety of support structures. The holder should accommodate vacuum cleaner hoses and should be compact for efficient shipping and pre-sale display.

There is also the need for a holder for holding both the corrugated vacuum cleaner hose and vacuum tubes in one location for ready access when needed.

SUMMARY OF THE INVENTION

The invention is a two-part mounted holder for corrugated vacuum cleaner hoses and tubes. The holder can be mounted on a variety of supports such as flat walls, unfinished walls having exposed studs, directly to a vacuum cleaner body, handles attached to a vacuum cleaner body, and the like. The holder stores coiled corrugated vacuum cleaner hoses and tubes of different types and sizes and consists of a pair of hose support members preferably molded from thermoplastic. The holder is compact and can be easily and inexpensively produced.

Each support member has a base and at least one hose engaging rib projecting outwardly from the base.

The support members are mounted across from each other on a support so that the ribs on each support member face each other and each rib extends outwardly from the support. The support may be a continuous flat surface, such as a wall or a side of a vacuum cleaner body; a non-continuous flat surface such as a wall having exposed wall studs; or two separated support structures, such as a pair of spaced apart beams, tubular vacuum cleaner handles, and the like. Each support member preferably includes a circular hose holder for securing and holding tapered vacuum cleaner tubes. Each tapered tube is fitted into a hose holder for storage adjacent the hose.

In use, a corrugated vacuum cleaner hose is coiled and opposite sides of the coil are compressed to fit between the support members. The hose is then positioned in the space between the support members and released. As the hose expands, the outer sides of the coil engage the ribs on the support members. The ribs fall into or seat in the valleys on the outer sides of the hose. The spring resilience of the coiled hose forces the hose against the ribs and holds the hose in place on the support members. If required, the hose can be coiled a number of times before being positioned between the support members and released. Vacuum cleaner hose tubes are fitted in the tube holder.

Other objects and features of the invention will become apparent as the description proceeds, especially when taken in conjunction with the accompanying 12 sheets of drawings illustrating embodiments of the invention.

DESCRIPTION OF THE PREFERRED EMBODIMENTS

Figure 1:
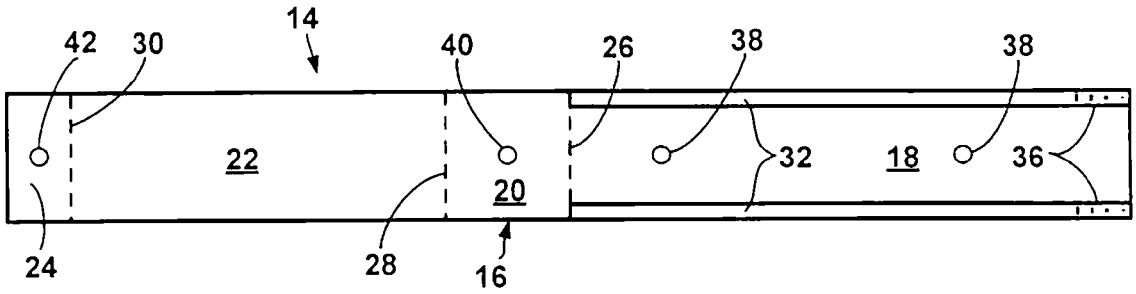
FIG. 1 is a top view of a preform for a first embodiment hose support member.
Figure 2:
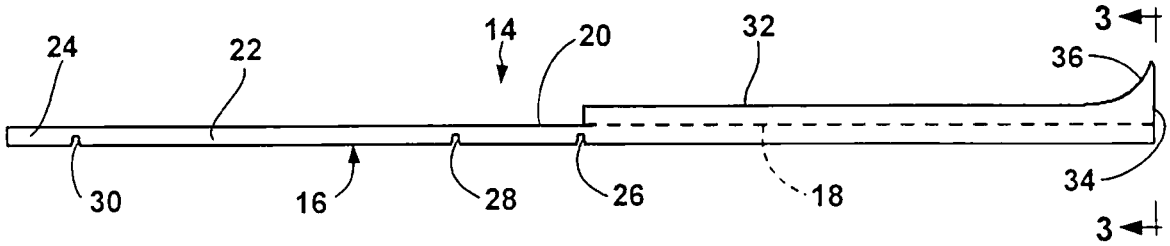
FIG. 2 is a side view of the preform shown in FIG. 1.
Figure 3:
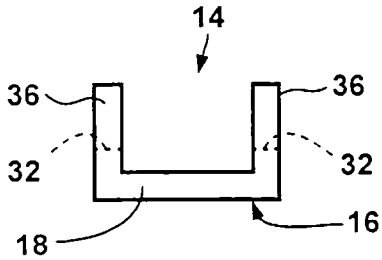
FIG. 3 is an end view of the preform shown in FIG. 1 taken along line 3-3 of FIG. 2.

Corrugated vacuum cleaner hose holder 10 (see FIG. 5) includes two hose support members 12 each formed from a molded plastic preform 14 shown in FIGS. 1-3.

Perform 14 includes an elongate rectangular base 16 extending the length of the preform. Rectangular base 16 has a uniform thickness. The base is made up of an elongate support panel 18 located at one end of the preform, a short support panel 20, an arm panel 22 and an attachment panel 24. Reduced thickness hinges 26, 28 and 30 join panels 18 and 20, panels 20 and 22 and panels 22 and 24 respectively.

A pair of hose support ribs 32 extend along the length of support panel 18 from hinge 26 to preform end 34. The ribs have a height above base panel 18 sufficient to extend into the valleys between corrugations in a vacuum cleaner hose. At end 34, the ribs extend outwardly above base support panel 18 to form hose retention lips 36. A pair of mounting holes 38 extends through base support panel 18. Mounting holes 40 and 42 extend through panels 20 and 24. Ribs 32 parallel each other and extend perpendicularly outwardly from base panel 18.

Figure 4:
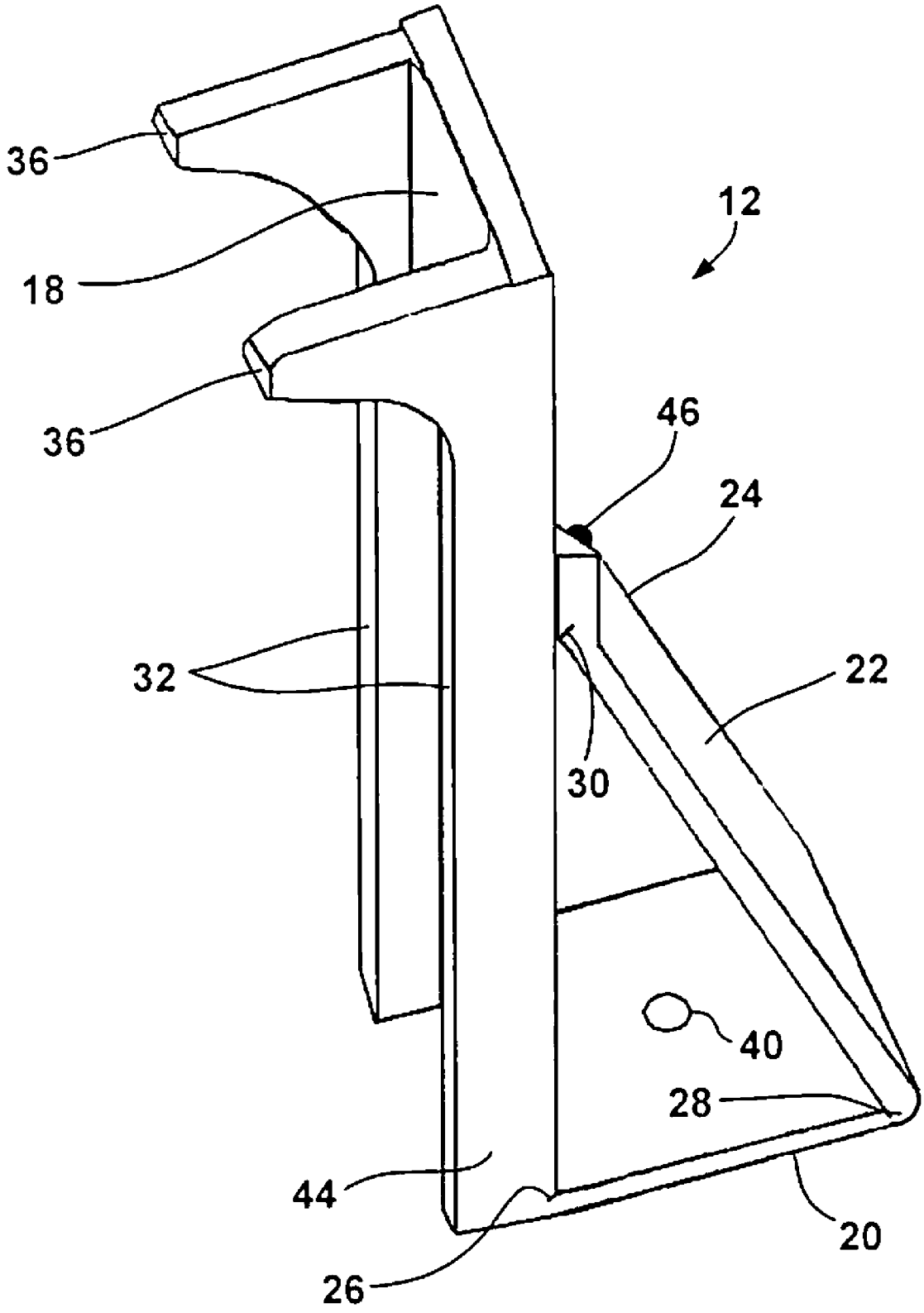
FIG. 4 is a perspective view of a first embodiment support member formed from the perform shown in FIGS. 1-3.

Preform 14 shown in FIGS. 1-3 may be folded to form hose support member 12 shown in FIG. 4. Support panel 18 is shown in the vertical position. Support panel 20 has been bent 90 degrees down from a position shown in FIG. 1 about hinge 26 so that it extends 90 degrees away from the lower end 44 of panel 18. Panel 22 is bent relative to panel 20 about hinge 28 through an angle greater than 90 degrees and angles back toward the upper end of panel 18. Panel 24 is bent through a shallow angle about hinge 30 and rests flush on panel 18, with hole 42 in panel 24 in alignment with hole 38 in panel 18. A suitable fastener 46, which may be a nut and bolt (or other threadable fastener), a pop rivet, or the like, extends through holes 42 and 38 to hold panel 24 against panel 18. Panel 22 supports panel 18 with ribs 32 extending outwardly as shown.

Figure 5:
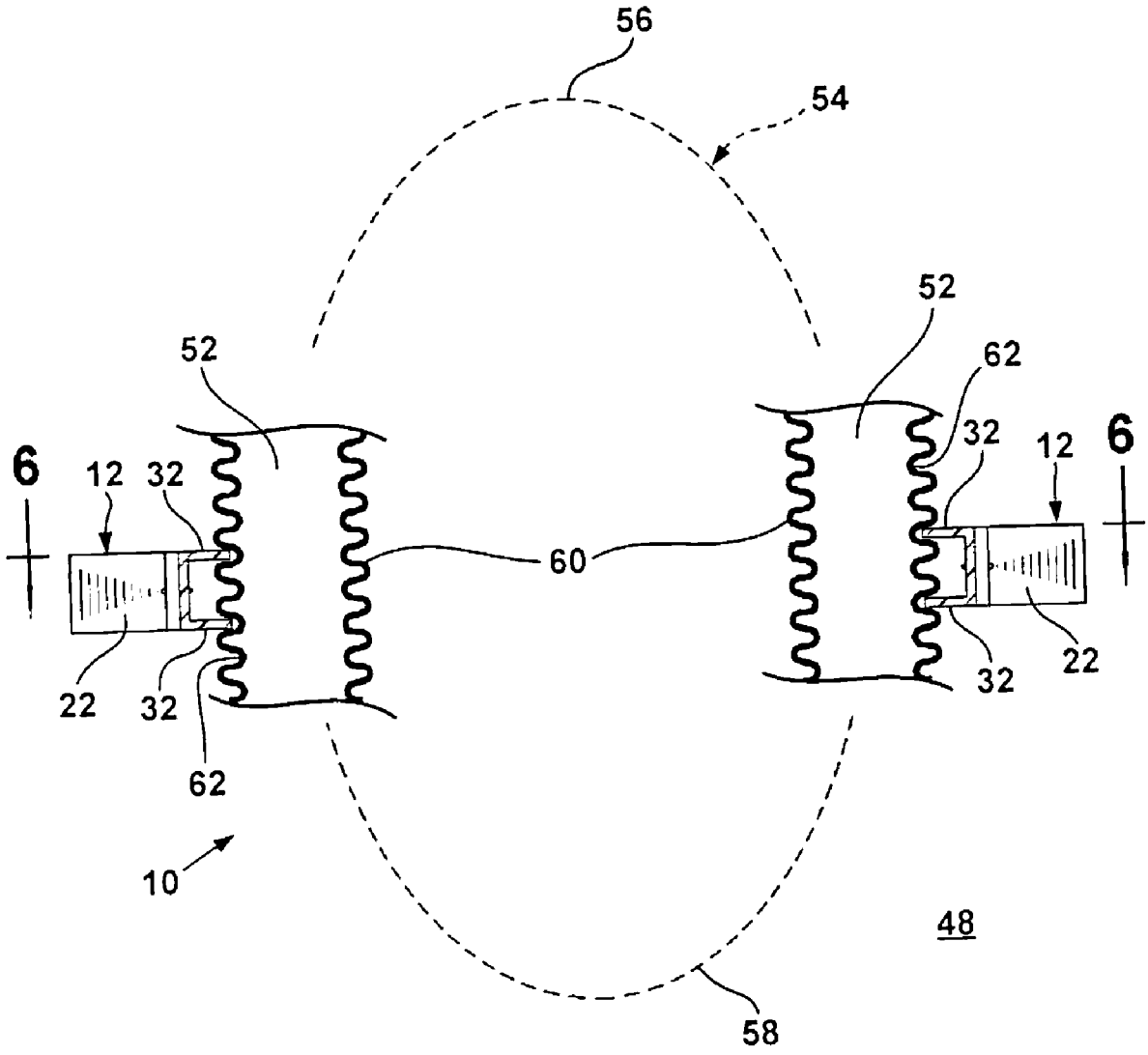
FIG. 5 is a front view, partially broken away, of a first embodiment hose holder with a pair of support members shown in FIG. 4.

FIG. 5 illustrates hose holder 10 supporting a coiled hose 52. Support members 12 are across from each other with ribs 32 facing each other.

Vacuum cleaner hose 52 may be formed from a corrugated plastic tube and is stiffly flexible about the corrugations. The corrugations may be spiral wound or circumferential. In order to mount hose 52 in holder 10, the hose is coiled into an elastically bowed section 54 having curved end sections 56 and 58 and side sections 60 extending between the end sections. The resiliency of the hose resists coiling and forms a spring biasing sides 60 outwardly or away from each other.

The coiled hose is placed in holder 10 by moving the sides 60 of the elastically bowed section 54 together a distance sufficiently close to permit moving the hose toward the wall past lips 36 and into space 33 between the ribs 32 of each support member 12. Elastically bowed section 54 is then released so that the side sections 60 move outwardly of section 54 due to the spring bias of the hose. Side sections 60 then engage ribs 32 as shown. The ribs 32 fit into valleys 62 between adjacent corrugations on the hose. The resiliency of the hose retains side sections 60 in engagement with ribs 32 so that the two support members 12 support the coiled hose on wall 48. Lips 36 prevent the coiled hose from moving outwardly from wall 48 and off holder 10.

FIG. 5 illustrates a single coil hose in holder 10. If desired, a number of coils may be held. The hose is easily removed from the holder 10 by moving side sections 60 together away from adjacent support members 12 and then withdrawing the hose away from the holder 10.

Holder 10 may also be used to support a corrugated vacuum cleaner hose having two side sections 60, a curved upper section extending between the side sections 60, and lower ends hanging free below side sections 60. The resiliency of the curved upper section forms a spring that holds side section 60 outwardly in engagement with ribs 32 as described.

Figure 6:
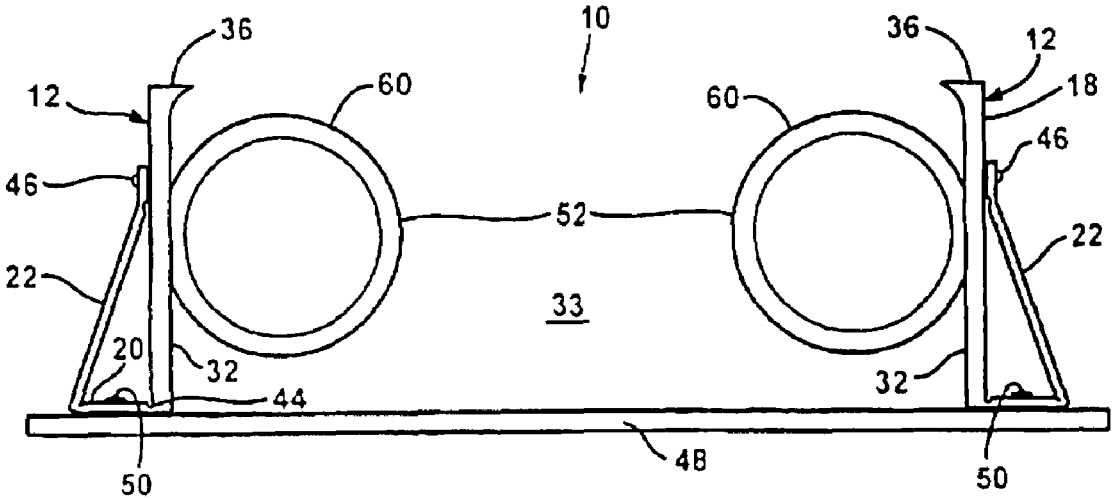
FIG. 6 is a sectional view taken along line 6-6 of FIG. 5, with the holder mounted on a vertical wall.

FIG. 6 illustrates hose holder 10 mounted on a vertical wall 28 and holding hose 52. The two hose support members 12 are mounted at the same level on vertical wall 48 with the ribs 32 of each support member facing the other support member. Panels 20 rest flush on wall 48 and are secured to the wall by suitable fasteners 50 extending through holes 40. As illustrated, the arm panels 22 support the panels 18 against outward deflection caused by hose 52 being mounted between the two hose support members 12.

Figure 7:
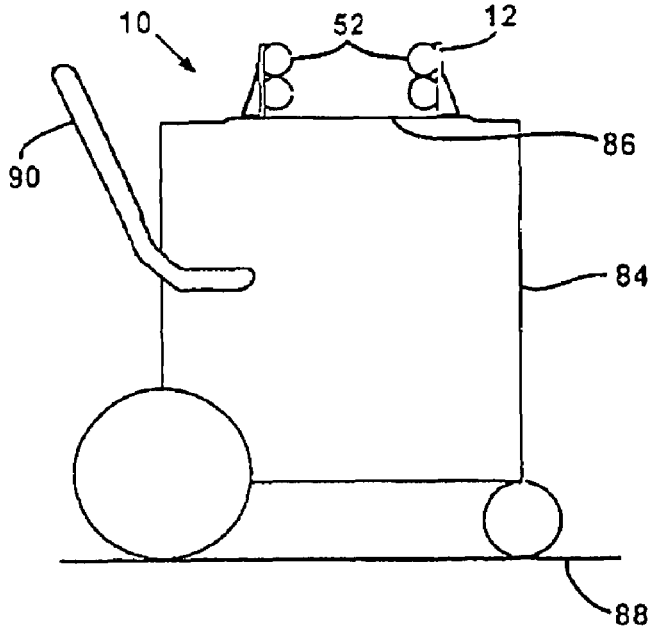
FIG. 7 is a side view, partially broken away, of the first embodiment hose holder mounted on a vacuum cleaner body.

FIG. 7 illustrates hose holder 10 mounted on a vacuum cleaner body 84. Body 84 has a flat surface 86 so that the holder is normally parallel to ground 88. The support members 12 are spaced sufficiently apart to hold a hose like hose 52. The hose is coiled, compressed, moved into the space between support members 12 and released as previously described. The orientation of holder 10 relative to the ground 88 does not affect use of holder 10.

A hose holder like holder 10 could also be integrally molded into vacuum cleaner body 84 with two integral support members like support members 12 having one or more ribs facing each other and spaced apart to receive a coiled hose. In yet another embodiment described further below, the hose holder is mounted on a handle 90 of vacuum cleaner body 84.

Figure 8:
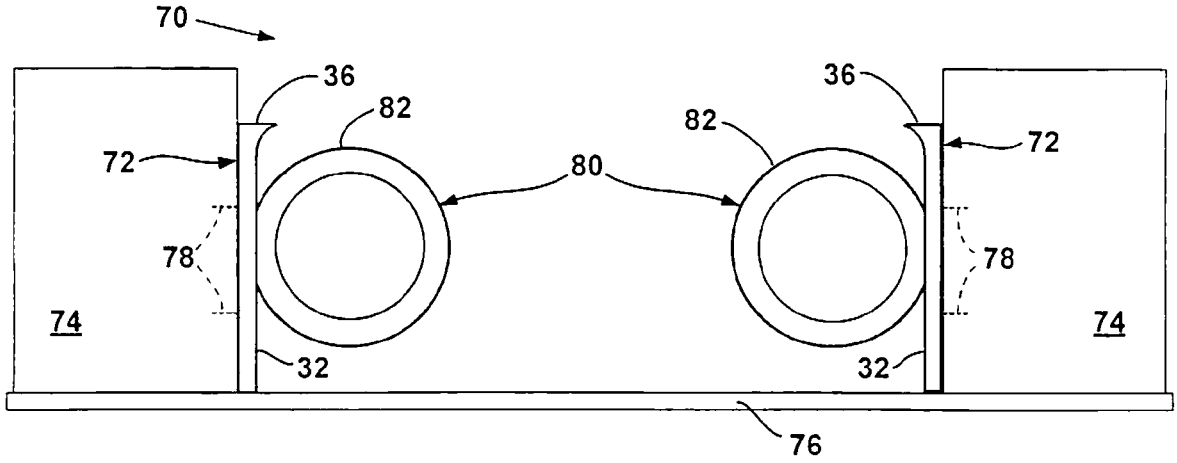
FIG. 8 is a view similar to FIG. 6 of a second embodiment hose holder mounted on exposed wall studs.

FIG. 8 illustrates a second embodiment hose holder 70 mounted on a pair of spaced apart wall studs 74. Holder 70 includes two hose support members 72. Each support member 72 is formed from a preform similar to perform 14 but including a support panel 18, with ribs 32 and lips 36. Base panels 20 and 22 shown in FIG. 1 are omitted and cut away at hinge 26.

Each support member 72 is attached to an interior surface of a stud 74 mounted on vertical wall 76 by suitable fasteners 78 extending through holes 38. Support members 72 extend outwardly perpendicularly from wall 76 at the same level with ribs 32 of each member facing the other member.

Holder 70 is shown holding coiled corrugated vacuum cleaner hose 80 between the two support members 72. The coiled hose is compressed, placed between support member 72, and then released so that the vertical sides 82 of the coil are elastically held outwardly into engagement with the inwardly facing ribs 32 to support the hose on wall 76.

The hose support members 12 and 72 each have two spaced hose retention ribs 32. The members may have single hose retention ribs as desired. A two-rib holder has the advantage that a mounting hole may be provided in the center of the support panel 18 and each member may be molded from a single mold. If a member were molded with a single side rib and a central mounting hole and the same member were mounted on both sides of the holder, the two ribs would be located at different levels, which would be aesthetically undesirable although functionally viable.

Figure 9:
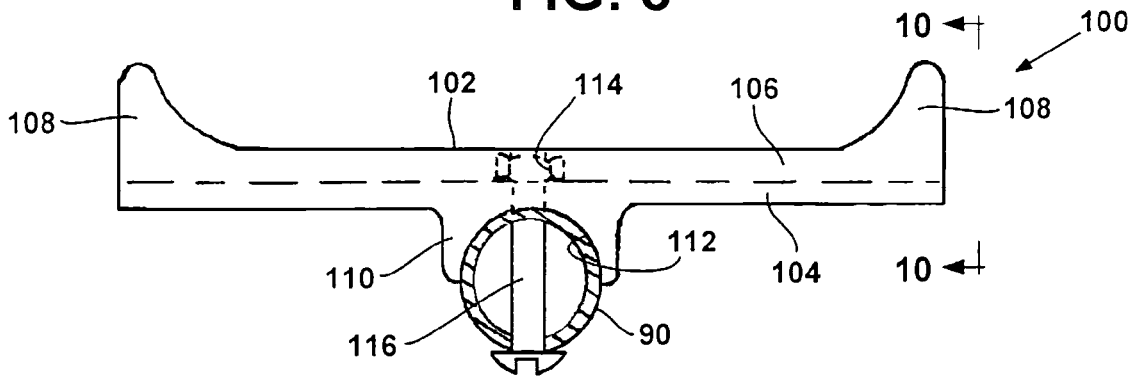
FIG. 9 is a side view of a third embodiment hose holder mounted on a tubular support.
Figure 10:
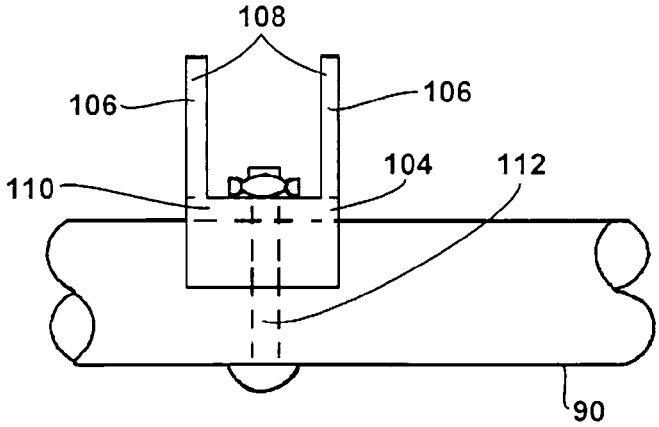
FIG. 10 is an end view of the third embodiment hose holder taken along line 10-10 of FIG. 9.
Figure 12:
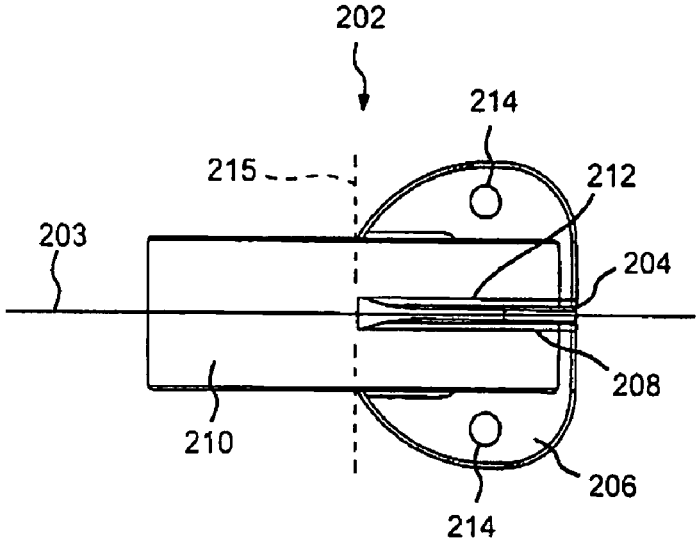
FIG. 12 is a top view of the fourth embodiment hose support member.
Figure 11:
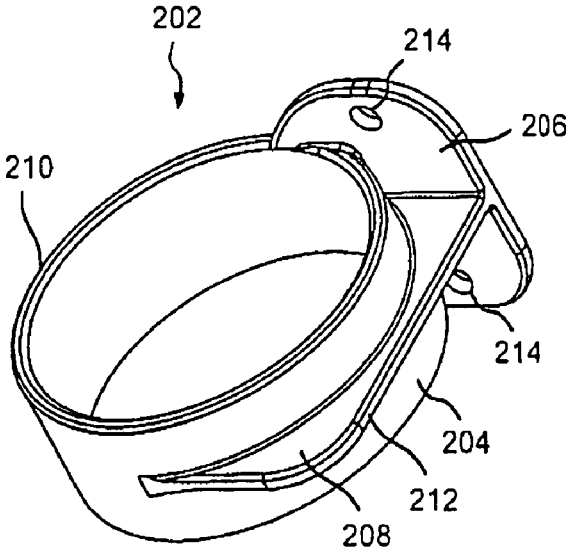
FIG. 11 is a perspective view of a fourth embodiment hose support member.
Figure 13:
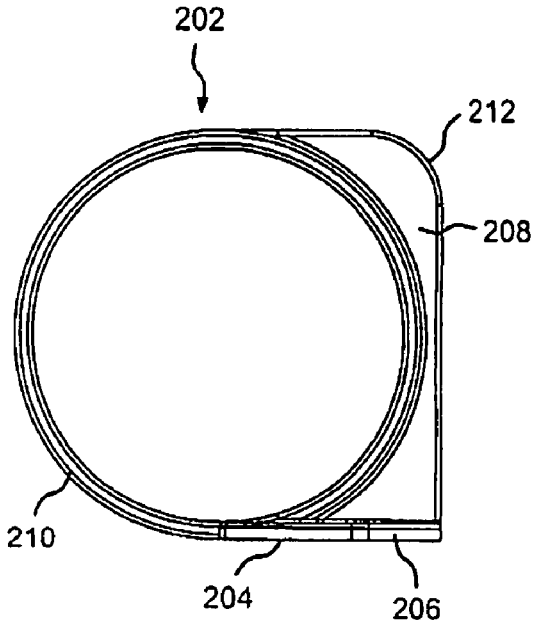
FIG. 13 is a side view of the fourth embodiment hose support member.

FIGS. 9 and 10 illustrate a third embodiment corrugated vacuum cleaner hose holder 100 suitable for mounting on tubular supports. Holder 100 includes two support members 102. Holder 100 is shown mounted on handle 90 of the vacuum cleaner body 84.

Each support member 102 has an elongate rectangular base 104 extending the length of the member. Rectangular base 104 has a uniform thickness. Two support ribs 106 extend along the length of base 104. Ribs 106 are similar to ribs 32 described above. Ribs 106 parallel each other and extend perpendicularly upward from base 104. Ribs 106 extend outwardly above each end of base 104 to form hose retention lips 108. Socket 110 formed on base 104 has a curved mounting surface 112 sized to receive the tubular support. Mounting hole 114 extends though base 104 and a socket 110.

The support members 102 are mounted on opposing sides of handle 90 so that the ribs 106 face each other. Handle 90 is received in sockets 110 and held by suitable fasteners 116 through the holes 114.

A coiled hose is mounted on holder 100 so that lips 108 retain the hose laterally and the compressed resiliency of the hose retains hose side sections in engagement with ribs 106 to capture the hose.

Sockets 110 may be adapted to receive supports having non-curved or irregular shapes in alternate embodiments.

FIGS. 11 through 19 illustrate a fourth embodiment corrugated vacuum cleaner hose holder 200 including two like support members 202.

Each support member 202 includes a unitary molded plastic body 204 having uniform thickness base 206, hose support rib 208 and tube holder 210. The rib 208 extends perpendicularly above base 206. Circular tube holder 210 is integrally formed with base 204 and rib 208. Rib 208 includes an L-shaped edge 212 extending partially around holder 210. A pair of mounting holes 214 extend though base 206. Mounting holes 214 allow support member 202 to be mounted to a surface or wall using nails, screws or other conventional fasteners.

Hose holder 200 includes two like support members 202. Each support member is mounted on a stud or wall to one side of a bowed hose. The ribs on the support members extend into corrugations or recesses in the hose to support the hose. In these applications, the hose support rib must be oriented perpendicular to the adjacent side sections of the hose, independent of whether the member 202 is mounted on a wall or exposed stud.

The ability to mount the support members in different locations on walls or studs for supporting corrugated vacuum cleaner hoses and tubes as described is facilitated by members 202 being symmetrical to either side of plane 203 extending through the center of rib 208 and tube holder 210.

When the support members 202 that make up hose holder 200 are mounted on a vertical surface, the axes 215 of tube holders 210 are parallel to the vertical surface and the planes of ribs 208 are perpendicular to the axis of hose holders 200.

Tube holder 210 is circular as shown to receive the small diameter ends of conventional tapered vacuum cleaner tubes 216. The small ends of the tubes are extended into holders 210 until the tube is wedge fitted in the holder and held in place until withdrawn is needed.

Figure 14:
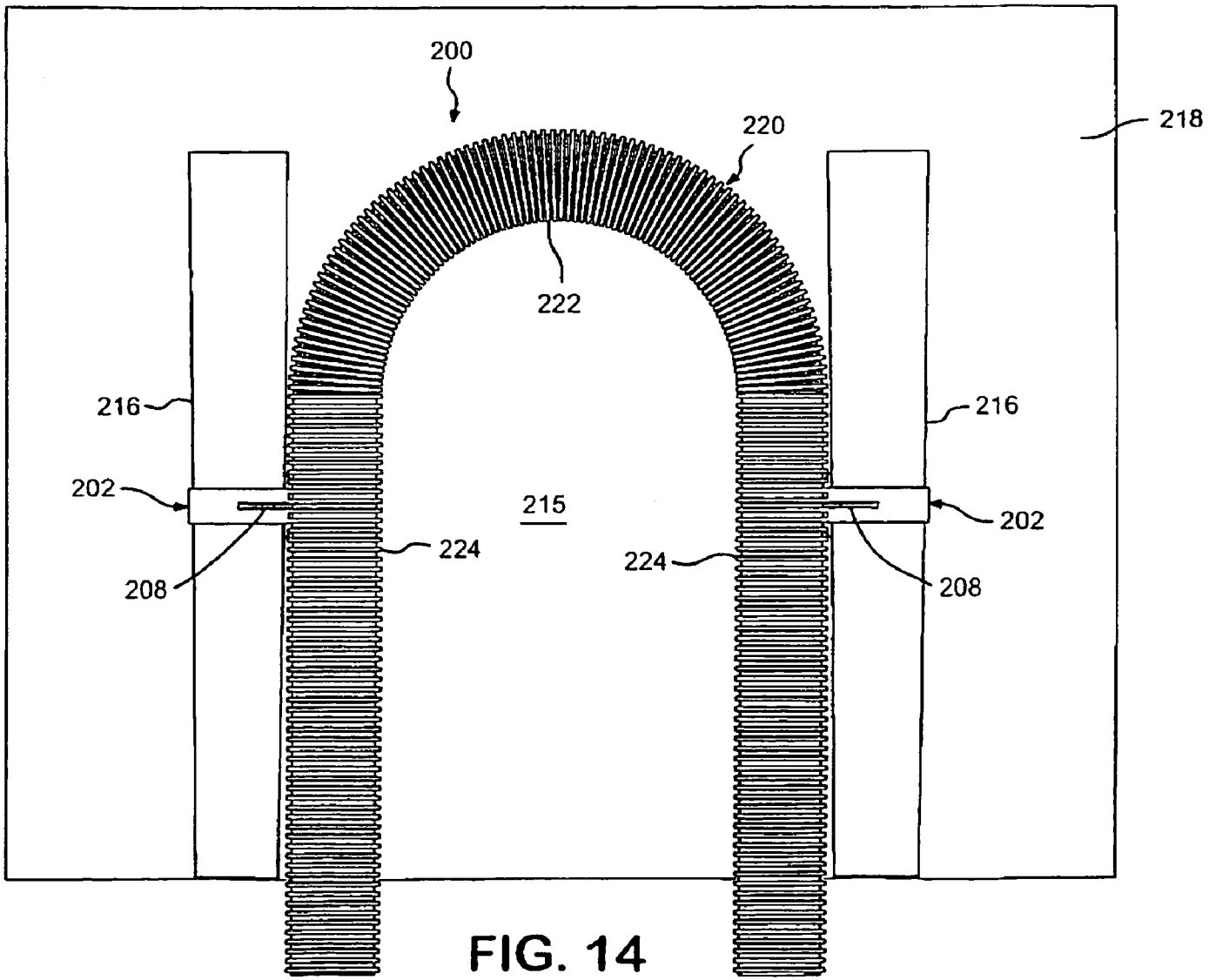
FIG. 14 is a front view of a fourth embodiment hose holder with a pair of support members mounted on a vertical wall.
Figure 15:
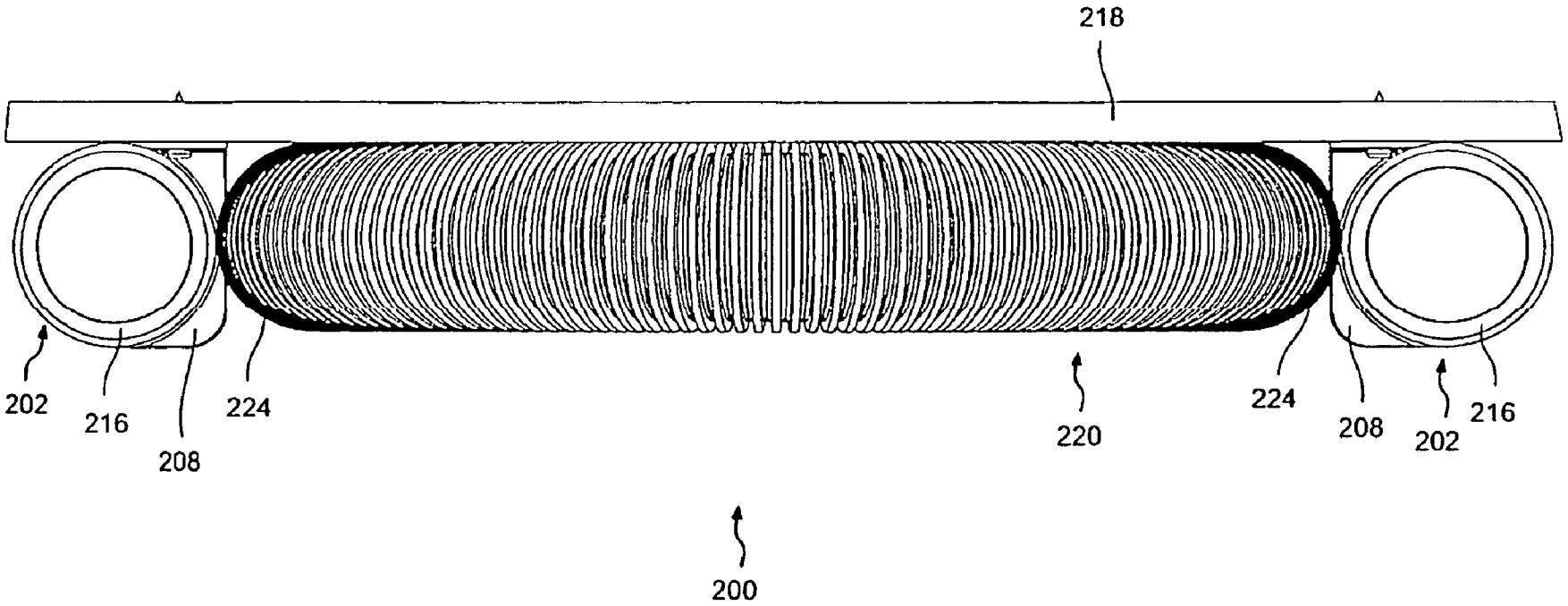
FIG. 15 is a top view of a fourth second embodiment hose holder mounted on a vertical wall.

FIGS. 14 and 15 illustrate hose holder 200 mounted on a vertical wall 218 supporting a bent corrugated hose 220. Support members 202 are mounted on the wall with horizontal ribs 208 facing each other. Hose 220 may be similar to hose 52 shown in FIG. 5, having an elastically bowed section 222 and side sections 224 extending from the bowed section. As in hose 52, the resiliency of hose 220 resists bending and forms a spring biasing sides 224 outwardly or away from each other and into engagement with ribs 208 as described above. The side sections 224 of the hose are moved together, positioned in space 215 between the support members 202, and then released so that ribs 208 seat in corrugations or valleys in the side sections of the hose. The ribs removably support the hose. Vacuum cleaner tubes 216 and side sections 224 extend parallel to tube holder axes 215 and parallel to each other.

Figure 16:
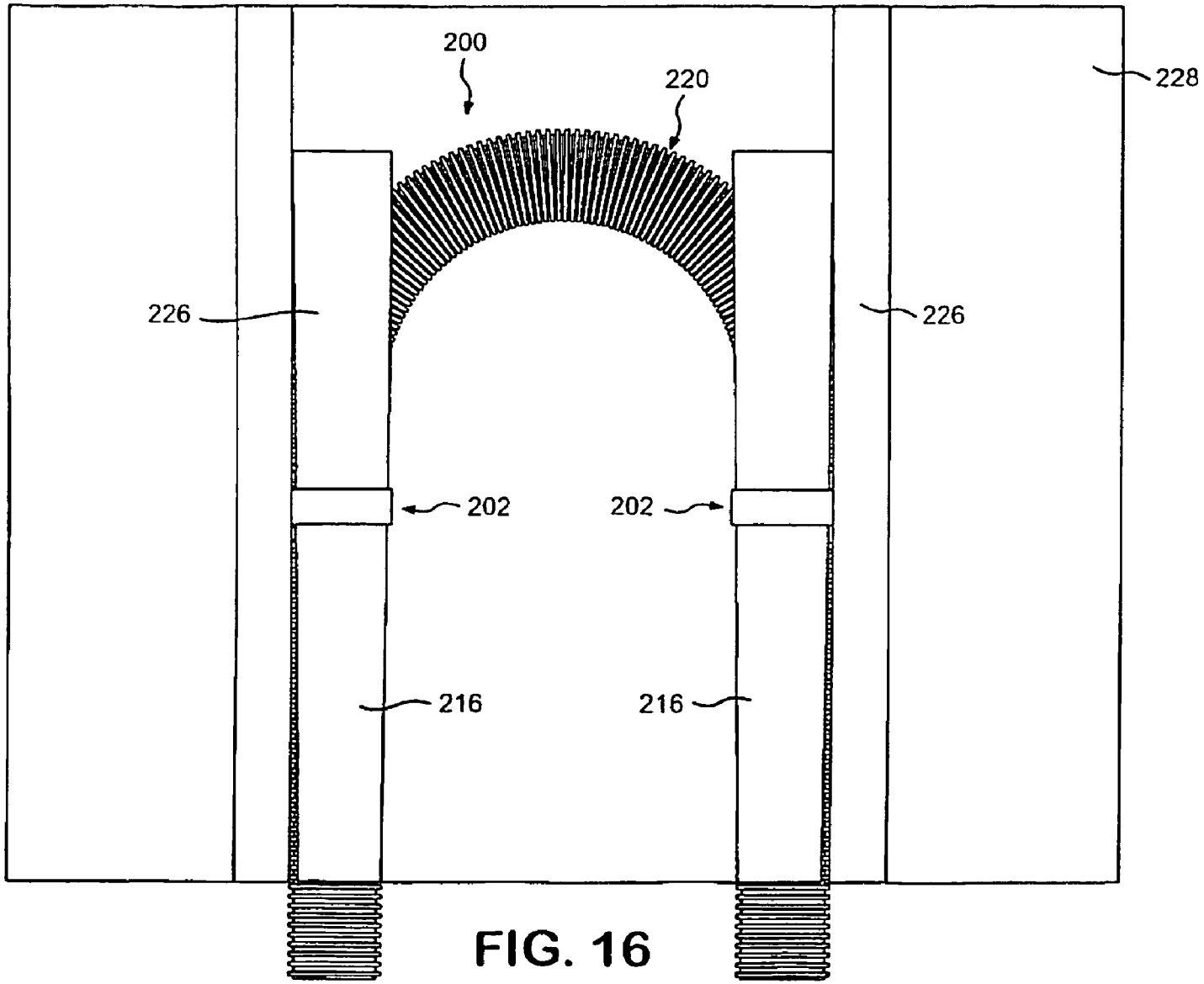
FIG. 16 is a front view of a fourth embodiment hose holder with a pair of support members mounted on exposed wall studs.
Figure 17:
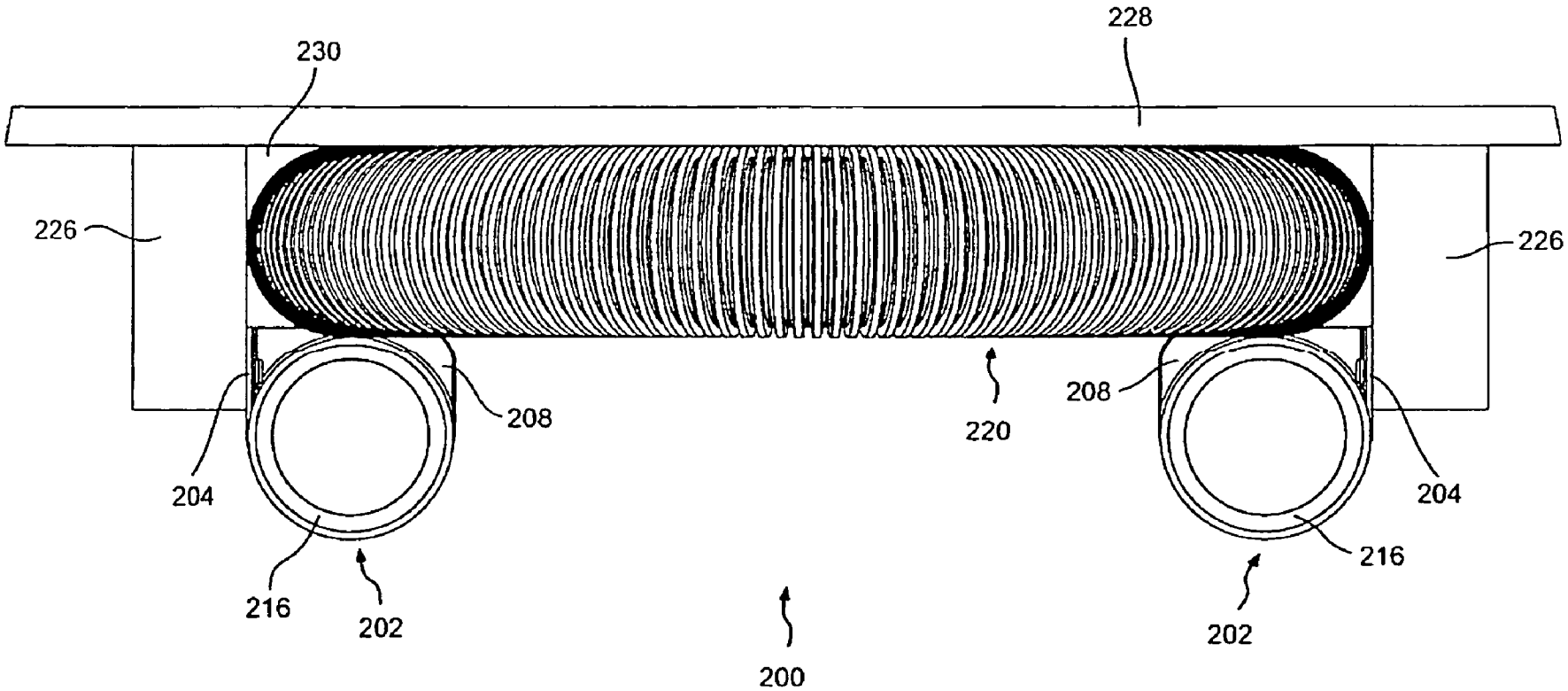
FIG. 17 is a top view of a fourth embodiment hose holder with support members mounted on exposed wall studs.

FIGS. 16 and 17 illustrate hose holder 200 mounted on a pair of spaced apart vertical wall studs 226 on wall 228. As shown in FIG. 17, support member bases 204 are mounted on studs 226 so that the members are spaced out from wall 228 and ribs 208 face wall 228. Hose 220 is compressed and side sections 224 are placed between members 202 and the wall with ribs 208 fitted in corrugations in the hose as described above so that each hose section 224 is held against a stud 226 in a cavity 230 formed between a member 202, stud 226 and wall 228. The ribs removably support the hose. Vacuum cleaner tubes 216 and side sections 224 extend parallel to tube holder axes 215 and parallel to each other.

Figure 18:
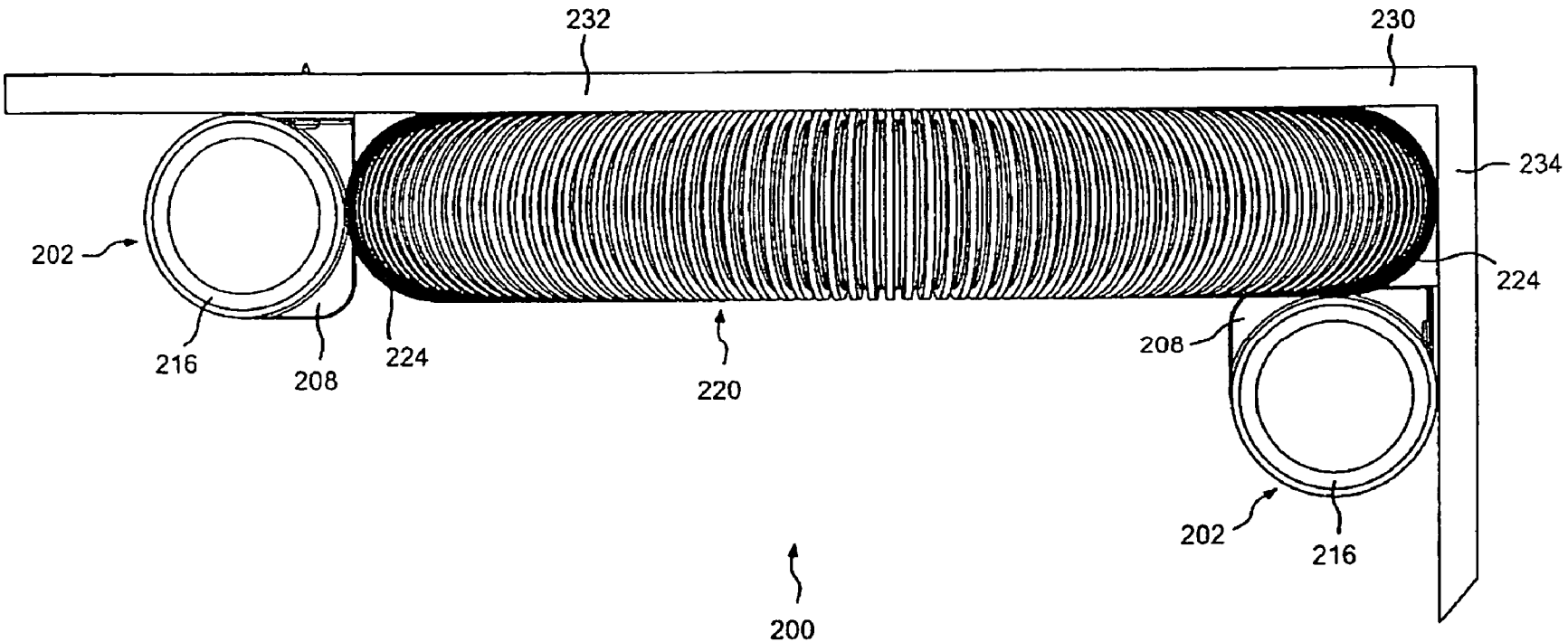
FIG. 18 is a top view of a fourth second embodiment hose holder with support members mounted on at the intersection of two vertical walls.
Figure 19:
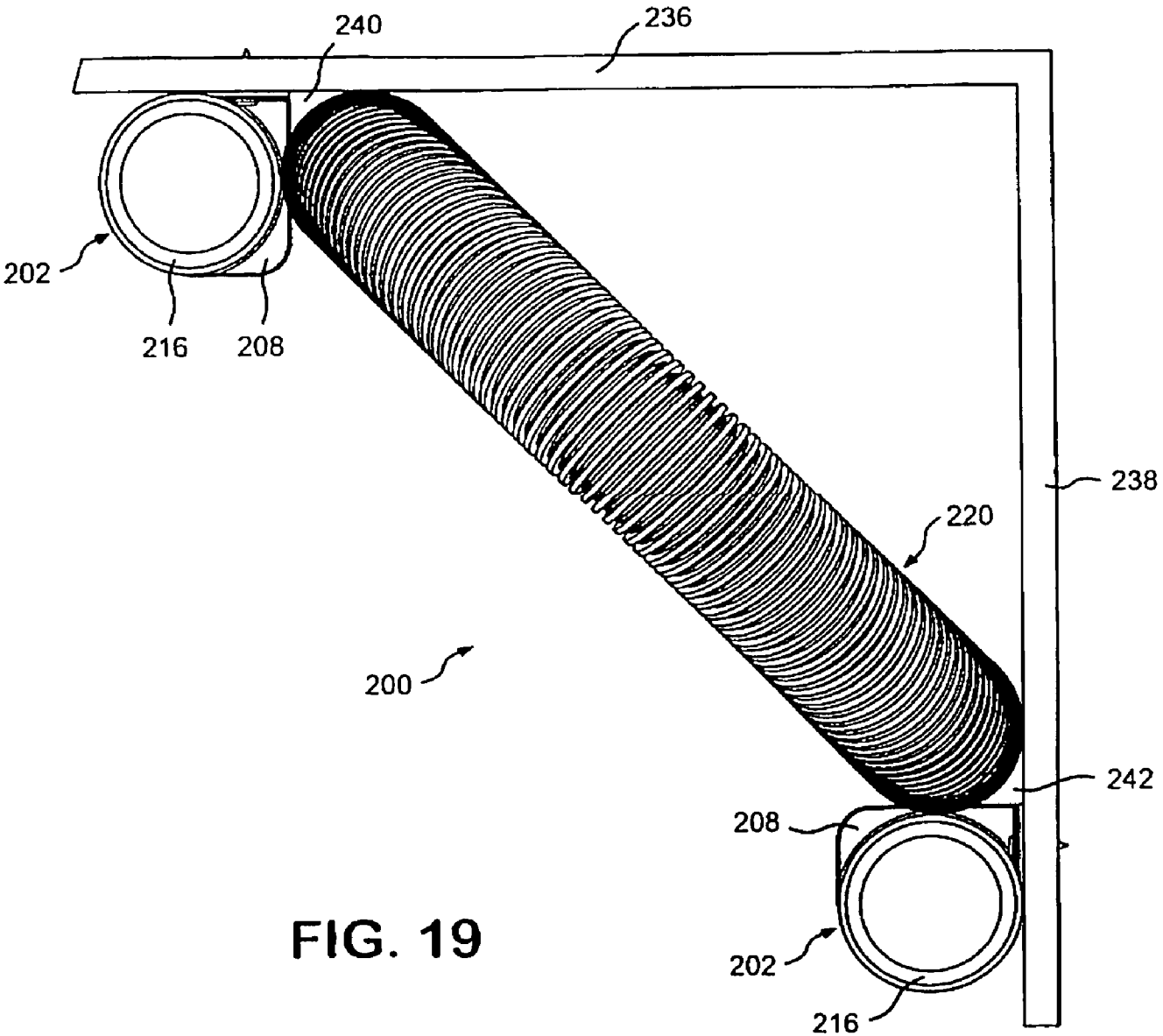
FIG. 19 is a top view of a fourth embodiment hose holder with support members mounted in the intersection of two vertical walls.

FIGS. 18 and 19 illustrate different mountings for hose holder 200 at wall corners.

FIG. 18 shows one support member 202 mounted on wall 232 so that rib 208 faces wall 234. A second support member 202 is mounted on wall 234 so that rib 208 faces wall 232. Hose 220 is compressed and mounted onto members 202 so that ribs 206 engage side sections 224. One section 224 is held in cavity 230 formed between member 202, wall 232 and wall 234 with rib 208 engaging the section as described. The other section 224 is held against the rib 208 of the member 200 mounted on wall 232 as described.

FIG. 19 shows one support member 202 mounted on wall 236 so that rib 208 faces wall 238 and a second support member 202 mounted on wall 238 so that rib 208 faces wall 236. Hose 220 is compressed and mounted onto holders 202 so that a section 224 is held in a cavity 240 formed between member 202 and wall 236 and the other section 224 is held in a cavity 242 formed between member 202 and wall 238 with ribs 208 fitted in corrugations in the tube.

In all embodiments, the pair of support members includes ribs that face each other and support a corrugated vacuum cleaner hose when positioned between the support members and released so that the side sections of the hose are biased apart against the ribs.

In FIGS. 5 and 6, the ribs 32 on support members 12 face each other directly. In FIGS. 14 and 15, the ribs 208 on members 202 face each other directly. In FIGS. 16 and 17, the sides of ribs 208 on support members 202 face each other directly. In FIG. 18, rib 208 on member 202 on the left of the figure directly faces the side of rib 208 on the member 202 to the right of the figure and the side of rib on member 202 on the right of the figure directly faces rib 208 on the member to the left. In FIG. 19, the two ribs 208 of members 202 face each other at an angle.

Plastic hose support members are disclosed. If desired, these members may be made of other materials having sufficient strength to support hoses and tubes, including wood and metal.

While I have illustrated and described preferred embodiments of my invention, it is understood that these are capable of modification, and I therefore do not wish to be limited to the precise details set forth, but desire to avail myself of such changes and alterations as fall within the purview of the following claims.

What I claim as my invention is:

1. The combination of a corrugated hose, a hose holder and a wall, wherein:

the hose holder has two spaced apart support members, each member having at least one rib adjacent the rib on the other support member;

the corrugated hose has valleys, an elastically bowed portion, and side sections located to either side of the bowed portion;

first and second open spaces are provided between the support members, each open space located adjacent one support member and extending toward the other support member to permit movement of the side sections when held toward each other between the support members;

the side sections are biased apart by the bowed portion when released between the support members to seat each rib in a valley on a side section so that the ribs hold the hose in place with at least one side section located in a cavity defined by one support member, the wall and a stud; and each support member is mounted on the stud extending from the wall and each support member has a tube holder for a vacuum tube to be mounted on the hose.

* * * * *